United States Patent [19]

Hoormann

[11] Patent Number: 4,646,904

[45] Date of Patent: Mar. 3, 1987

[54] COIN SIZING MEANS AND METHOD

[75] Inventor: Ronald A. Hoormann, St. Peters, Mo.

[73] Assignee: Coin Acceptors, Inc., St. Louis, Mo.

[21] Appl. No.: 772,703

[22] Filed: Sep. 5, 1985

[51] Int. Cl.[4] ..... G07D 5/02

[52] U.S. Cl. ..... 194/334; 250/223 R

[58] Field of Search ..... 194/334; 250/223 R

[56] References Cited

U.S. PATENT DOCUMENTS 4,474,281 10/1984 Roberts et al. ..... 194/334 X
4,509,633 4/1985 Chow ..... 194/334
4,585,936 4/1986 Sellier ..... 194/334 X

FOREIGN PATENT DOCUMENTS 2724869 12/1978 Fed. Rep. of Germany ..... 194/334

*Primary Examiner*—F. J. Bartuska
*Attorney, Agent, or Firm*—Haverstock, Garrett and Roberts

[57] ABSTRACT

A coin sizing circuit and method of operation therefor for use with a coin-operated vending system for distinguishing between various deposited coins as they travel along a predefined path, comprising first and second spaced sensors positioned to detect the movement of a deposited coin thereby, the sensors being responsive to movement of the deposited coin to produce an initial sensing status signal and two further sensing status signals as the coin moves along the predefined path by the sensors and reaches particular positions relative thereto, a memory having predetermined coin sizing data stored therein, and processing circuitry, preferably a programmed microprocessor, operatively connected to the sensors to receive the sensing status signals produced thereby and also operatively connected to the memory to permit the retrieval therefrom of the data stored therein. The processing circuitry is responsive to production of the initial sensing status signal and the first occurring of the two further sensing status signals to establish a time window interval, and is subsequently responsive to production within the time window interval of the second occurring of the two further sensing status signals so as to distinguish a coin whose movement past the sensors effects production within the time window interval of the second occurring of the two further sensing status signals from other coins whose movements past the sensors effect productions of the second occurring of the two further sensing status signals at times outside of the time window interval.

23 Claims, 16 Drawing Figures

$t=t_0$ $t=t_{1S}$ $t=t_{2S}$ $t=t_{3S}$

COIN SIZING MEANS AND METHOD

BACKGROUND OF THE INVENTION

This invention relates to coin sizing means and method, and, more particularly, to a means and method for use with a coin-operated vending system for detecting undesired and counterfeit coins, slugs, and non-coin objects deposited or inserted into such system and for distinguishing acceptable coins therefrom, and for determining or assisting in determinations of the denominations of the acceptable coins.

It will be appreciated that, throughout this application, the term "coin" may be employed to mean any coin (whether valid or counterfeit), token, slug, washer, or other item which might be used by an individual in an attempt to operate a coin-operated device or system. An "acceptable coin" is considered to be an authentic coin, token, or the like of the monetary system or systems in which or with which the coin-operated device or system is intended to operate and of a denomination which the device or system is intended selectively to receive and to treat as an item of value.

Coin-operated devices and systems of many types and variations have come to be widely employed and are now widely utilized by the consuming public in everyday life. For proper operation, many of such coin-operated devices must employ verification means of various types for distinguishing between acceptable and unacceptable coins and for discriminating between various denominations of acceptable coins. Various means and apparatuses have been employed for such purposes, and, in recent years, the use of multiple coin verification means has become widespread in an effort to defeat increasingly sophisticated attempts to "cheat" the coin-operated devices in various manners.

In many coin-operated devices in use today, coin acceptor means are provided for checking the dimensions of a deposited coin to determine whether or not such coin is of a proper size to be an acceptable coin. Most devices that perform such coin sizing checks include some form of mechanical coin sizing means to determine coin dimensions, and some also make use of electrical or electronic means for determining or measuring coin dimensions, including such means as are disclosed and described in U.S. Pat. Nos. 3,653,481; 3,739,895; 3,797,307; 3,797,628; and 4,509,633. The present invention is designed and intended to be used for electronically distinguishing between various dimensioned coins deposited in a coin-operated device, and may be readily utilized in conjunction with mechanical coin sizing means and with various other coin verification means in use today or which may be hereafter developed or employed for validating coins, including with means that distinguish between and verify denominations of coins based upon certain characteristics of the coins.

SUMMARY OF THE INVENTION

The present invention includes first and second spaced sensing means positioned to detect the movement thereby of a deposited coin, a processing means connected to said sensing means to monitor the status of such sensing means, and memory means operatively connected to said processing means, which memory means stores predetermined information or data regarding or corresponding to dimensional tolerances of acceptable coins. As a deposited coin moves past the sensing means the processing means monitors the status of such sensing means and, based upon the measured length of time between an initial change in status of the first sensing means and a subsequent change in status of one of the sensing means, as well as the predetermined coin tolerance information stored in the memory means, calculates a time window within which a further status change of one of the sensing means must occur in order for the coin to be treated as an acceptable coin of a given denomination. The processing means thereafter monitors the sensing means to determine whether the anticipated further change in status of the sensing means actually occurs within the calculated time window, in which case the coin is treated by the coin sizing means of the present invention as an acceptable coin. If desired or required by the coin-operated device with which the present invention is utilized, time windows for a plurality of coin denominations can be readily calculated, and the processing means can operate to identify by dimension and to distinguish between various coins of different denominations.

As will become more apparent hereinafter, the processing means of the present invention preferably includes a microprocessor programmed to monitor the sensing means, to time the elapsed time from an initial status sensing signal to the first subsequent status sensing signal, to perform the necessary calculations to identify a time window within which a further status sensing signal is anticipated if the particular deposited coin is an acceptable coin, and to check for the occurrence of the anticipated status sensing signal within the calculated time window. In other embodiments, the processing means could equally as well be a custom chip or could even include discrete components connected in circuit to effect operations in a manner similar to the operations of a programmed microprocessor.

A principal object of the present invention is therefore to provide a means and method for use in a coin-operated vending system for distinguishing between acceptable and non-acceptable coins deposited by customers.

A further object is to provide a means and method for identifying undesired and counterfeit coins, tokens, slugs, and non-coin objects, and for also determining or aiding in the determinations of denominations of acceptable coins.

A still further object is to provide an electronic means for differentiating various coins from one another on the basis of such coins' differing physical dimensions.

Another object is to provide a coin sizing means that can be readily employed with other coin verification means to distinguish between acceptable and unacceptable coins.

A further important object is to provide a microprocessor controlled means capable of distinguishing various denominations of acceptable coins from one another on the basis of their sizes.

These and other objects and advantages of the present invention will become apparent after considering the following detailed specification in conjunction with the accompanying drawings, wherein:

DESCRIPTION OF THE PREFERRED EMBODIMENTS

Figure 1:
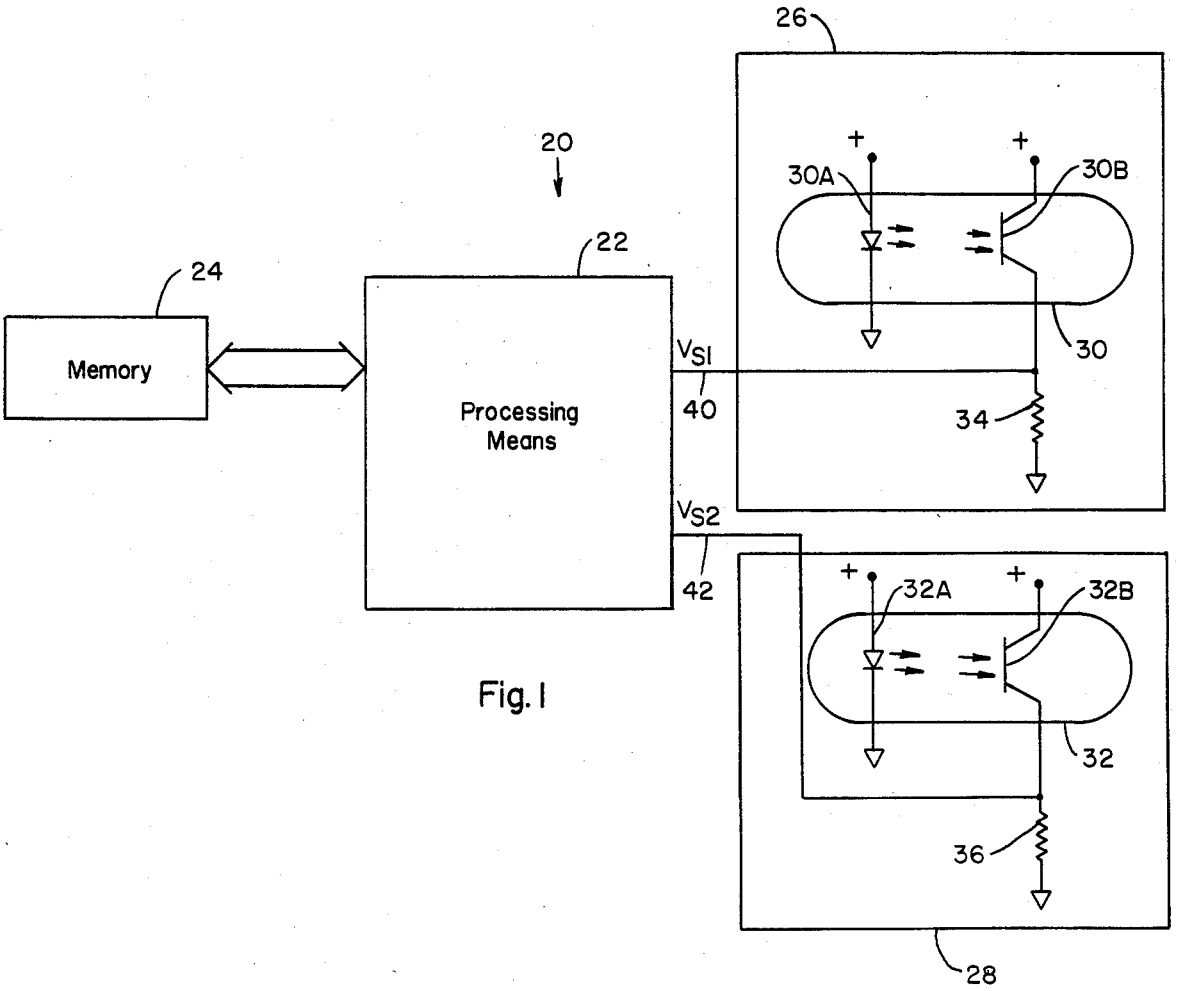
FIG. 1 is a schematic diagram, partly in block form, of a preferred embodiment of the present invention, depicting the major components of the invention.

Referring now to the drawings more particularly by reference numbers, wherein like numbers refer to like items, number 20 in FIG. 1 refers to a coin sizing circuit constructed according to the present invention and including a processing means 22 operatively connected to a memory means 24 and to first and second sensing means 26 and 28. In the preferred embodiment depicted, the sensing means 26 and 28 include respective optical couplers 30 and 32, each of which has a light emitting diode portion 30A or 32A and a phototransistor portion 30B or 32B. For ease of reference, optical coupler 30 will occasionally be referred to hereinafter as sensor $S_1$ and optical coupler 32 will occasionally be referred to as sensor $S_2$. The emitter of each phototransistor portion is connected to ground through a respective resistor 34 or 36 and to the processing means 22 through a respective lead 40 or 42, on which leads are produced respective signals $V_{S1}$ and $V_{S2}$.

Figure 2:
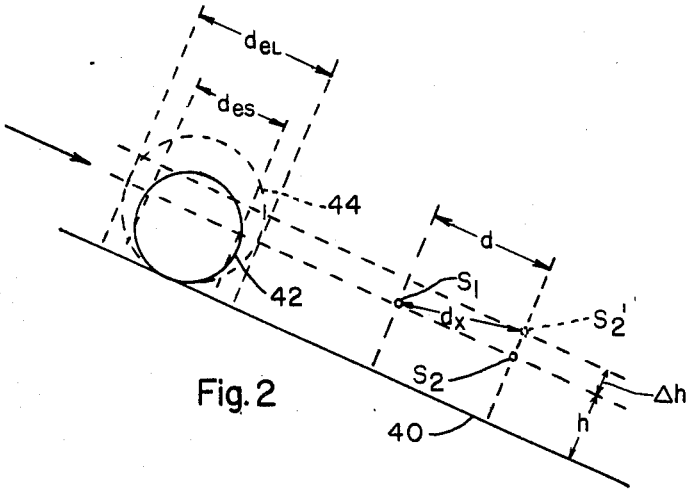
FIG. 2 is an illustration depicting a typical positioning of the sensing means relative to coin movements along a coin rail.
Figure 3:
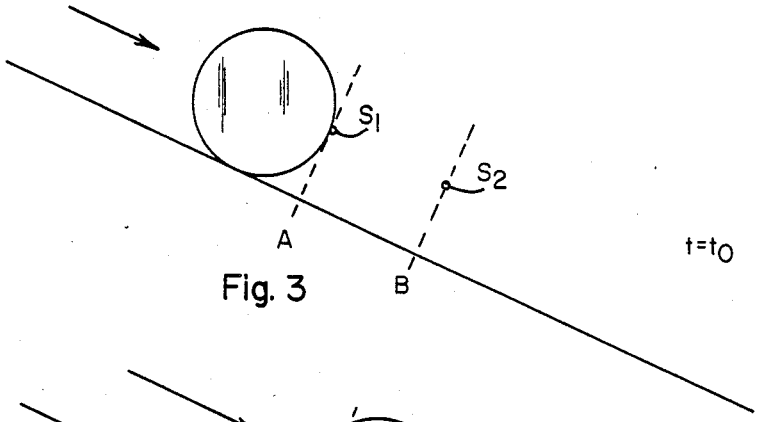
FIGS. 3–6 depict the movement of a coin having a relatively large diameter past the sensing means.
Figure 4:
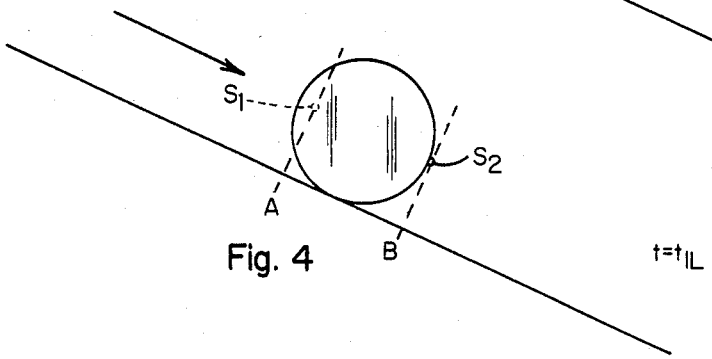
Figure 5:
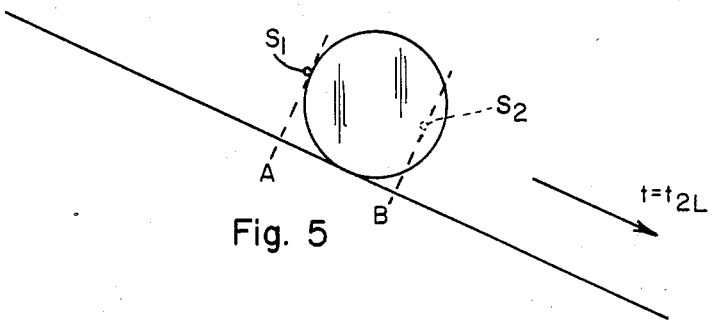
Figure 6:
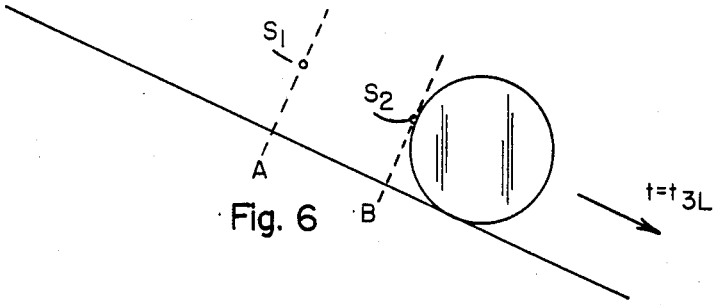

In a typical coin acceptor means, after or during certain mechanical coin sizing checks, coins move along an inclined coin rail 40, in a manner similar to that depicted in FIG. 2. The sensors $S_1$ and $S_2$ of the present invention may be easily installed in a spaced relationship along the coin rail 40 in such positions that, as coins ranging in size from the smallest acceptable coin 42 to the largest acceptable coin 44 move along the coin rail, such coins will move past the two sensors. Although the longitudinal spacing d between the sensors and the height positioning h of such sensors above the rail 40 may be subject to variation, depending upon the monetary system with which the invention is to be employed, it has been found that a spacing d between the sensors of approximately 0.7 inches and a height positioning h of the sensors above the coin rail 40 of approximately 0.4 inches are particularly advantageous when the present invention is employed to detect and distinguish between denominations of U.S. coins. Such a spacing d between the sensors is less than the effective diameters (the chord lengths of the coins at height h above the coin rail) of the larger diametered U.S. coins, such as the nickel, quarter, and dollar coins, but more than the effective diameter of the smallest diameter U.S. coin, the dime.

As will be appreciated by those skilled in the art, and as is explained in U.S. Pat. No. 4,509,633, the true diameter $D_t$ of a coin and its effective diameter $d_e$ are related to one another by the equation $D_t=(0.25\times(d_e)^2+h^2)/h$, where h is the height of the sensors above the coin rail, which equation can be rewritten as $d_e=\sqrt{((D_t\times h)-h^2)/0.25}$. For purposes of the present application, a large diameter coin is considered to be a coin whose effective diameter is greater than the spacing d between the sensors, and a small diameter coin is considered to be a coin whose effective diameter is less than such spacing d. FIGS. 3–6 thus depict the movement of a coin of relatively large diameter, such as a U.S. nickel, quarter, or dollar past the sensors $S_1$ and $S_2$, while FIGS. 8–11 depict the movement of a coin of relatively small diameter, such as a U.S. dime, past such sensors.

Figure 7:
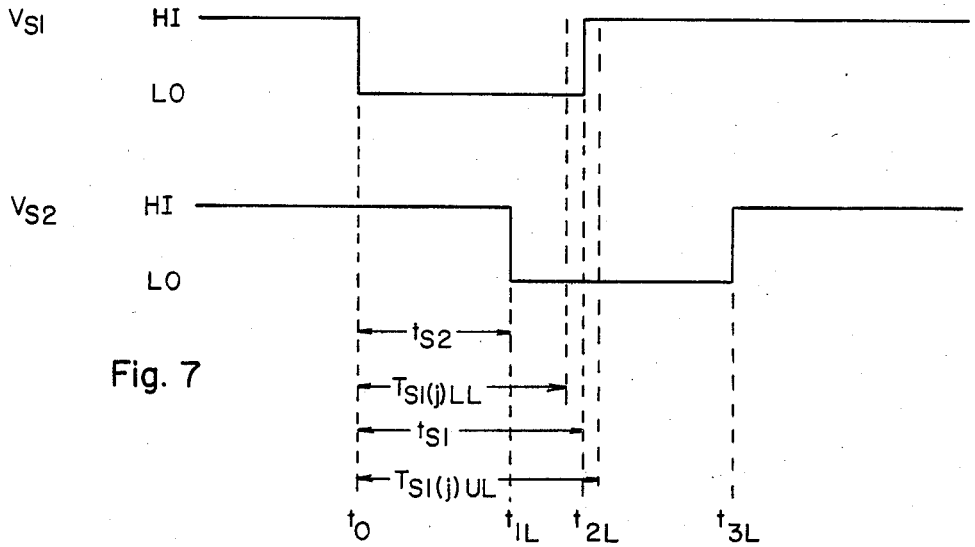
FIG. 7 is a timing diagram showing the status of the sensing means during the period of FIGS. 3–6.
Figure 12:
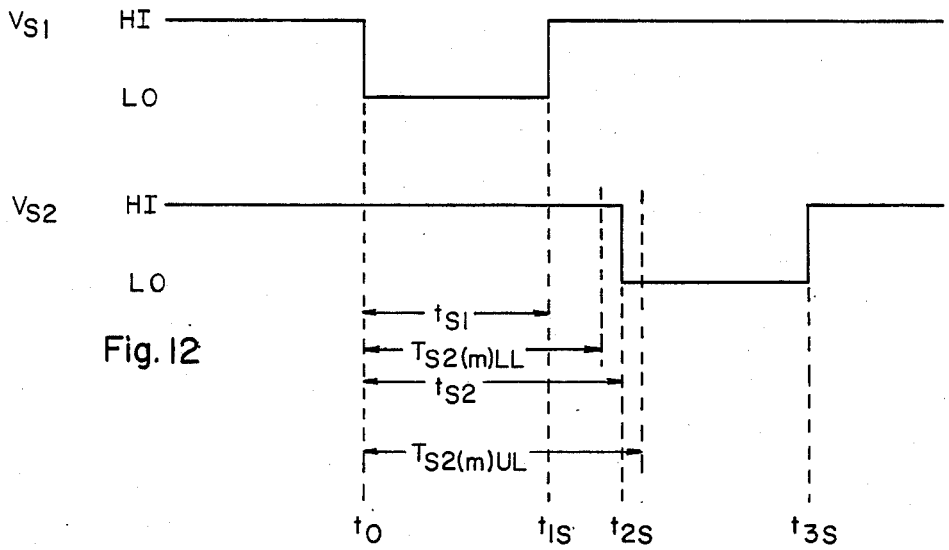
FIG. 12 is a timing diagram showing the status of the sensing means during the period of FIGS. 8–11.
Figure 8:
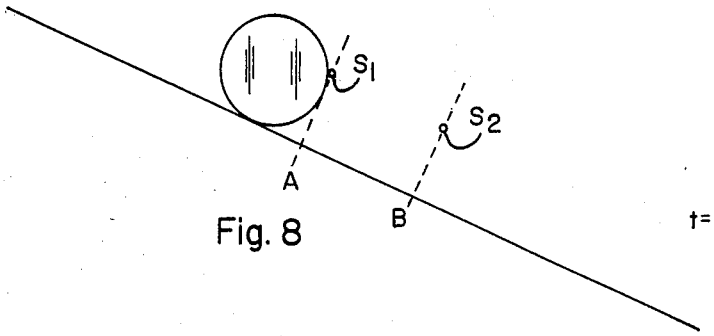
FIGS. 8–11 depict the movement of a coin having a relatively small diameter past the sensing means.
Figure 9:
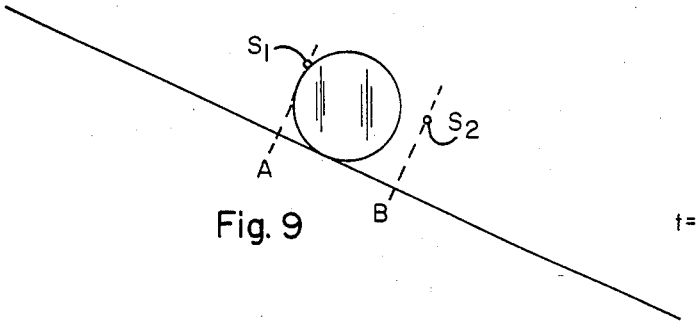
Figure 10:
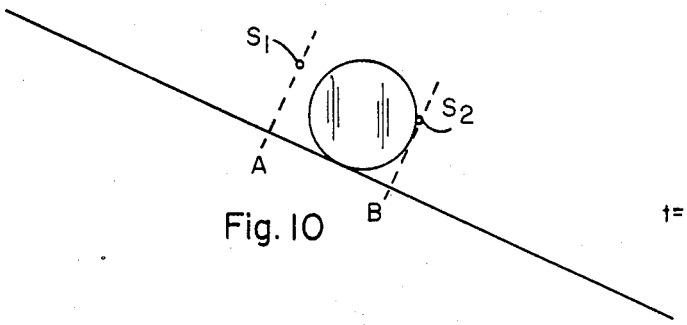
Figure 11:
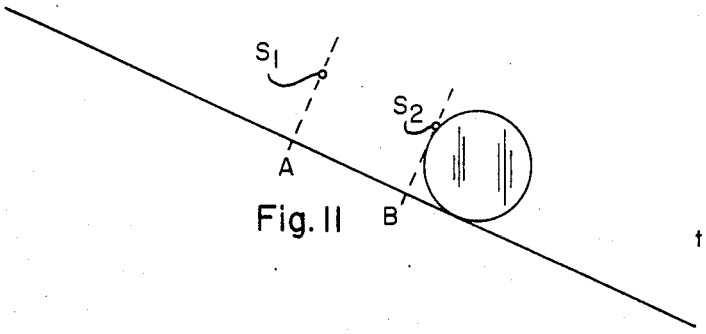

Referring again now to FIG. 1, it will be appreciated that, in the absence of any coin at the location of a sensor $S_1$ or $S_2$, the phototransistor portion 30B or 32B thereof will be conducting, as a consequence of which the signal present on the respective lead 40 or 42 will be HI. If a coin moves into a position between the light emitting diode portion and the transistor portion of the sensor, such that the light emitted by the light emitting diode portion cannot be detected by the phototransistor portion, the phototransistor portion will cease conducting and the signal present on the respective lead 40 or 42 will go LO. Thus, when a large diameter coin moves past the sensors $S_1$ and $S_2$, as shown in FIGS. 3–6, signals such as those depicted in FIG. 7 are produced on leads 40 and 42 (FIG. 1). Similarly, when a small diameter coin moves past the sensors $S_1$ and $S_2$ as shown in FIGS. 8–11, signals such as those depicted in FIG. 12 are produced on leads 40 and 42. By calculating the time duration between an initial change in status of sensor $S_1$ and the first subsequent change in status of either of the sensors $S_1$ and $S_2$, it is possible, with the use of predetermined coin tolerance information stored in memory means 24, to calculate a time window within which a subsequent change in status of one of the sensors $S_1$ and $S_2$ must occur if the coin is an acceptable coin of a given denomination.

By way of example, when a large diameter coin passes the sensors in a manner such as is depicted in FIGS. 3–6, the status of signal $V_{S1}$ on lead 40 will change from a HI to a LO at time $t_0$, as depicted in FIG. 7, as the leading edge of the coin reaches point A and begins to move past sensor $S_1$. Thereafter, since the effective diameter $d_{eL}$ of the large diameter coin is greater than the spacing d between the sensors $S_1$ and $S_2$, the next change in status of the signals on leads 40 and 42 will occur at a time designated $t_{1L}$ when the leading edge of the coin reaches point B and begins to move past sensor $S_2$. At such time the signal $V_{S2}$ on lead 42 will change from a HI to a LO while signal $V_{S1}$ on lead 40 remains LO. Subsequently, as the coin continues its movement, the trailing edge thereof will reach point A at time $t_{2L}$ when the coin has completed its movement past sensor $S_1$, as a consequence of which the signal $V_{S1}$ on lead 40 will return HI. Signal $V_{S2}$ will remain LO at such time and will not subsequently return HI until the trailing edge of the coin reaches point B at time $t_{3L}$, at which time the coin will have completed its movement past sensor $S_2$.

It will be appreciated that the elapsed time between $t_0$ and $t_{1L}$, defined as $t_{S2}$ (the elapsed time between $t_0$ and the first subsequent change in the status of sensor $S_2$), is inversely related to the velocity $V_2$ of the coin in traversing the longitudinal distance d between sensors $S_1$ and $S_2$, as set forth in the equation $t_{S2}=d/V_2$, and that the elapsed time between $t_0$ and $t_{2L}$, here defined as $t_{S1}$ (the elapsed time between $t_0$ and the first subsequent change in the status of sensor S1), is inversely related to the velocity $V_1$ of the coin as it moves past sensor $S_1$, that is, as it moves a distance equal to the effective diameter $d_{eL}$ of such coin, as set forth in the equation $t_{S1}=d_{eL}/V_1$. Due to the proximity of sensors $S_1$ and $S_2$ to one another, especially when a spacing d therebetween of approximately 0.7 inches is employed, it has been found that velocities $V_1$ and $V_2$ may be treated as being essentially equal to one another, as a consequence of which, for a deposited large diameter coin whose elapsed time $t_{S2}$ to traverse the distance d between the sensors has been measured, the anticipated elapsed time $t_{S1}$ required for such coin to pass sensor $S_1$, if such coin is an acceptable coin, can be calculated to be $t_{S1}=(d_{eL}\times t_{S2})/d$, where $d_{eL}$ is the known effective diameter of an acceptable coin of such denomination.

It will be appreciated that, since the true diameters of acceptable coins of any given denomination j may vary from one another within certain limits, the effective diameters of coins of such denomination will also vary within certain limits, as a consequence of which the range of the effective diameters $d_{eL}$ of a denomination j of large diameters coins can be expressed as $D_{eLmin(j)}<d_{eL}<D_{eLmax(j)}$ where $D_{eLmin(j)}$ is the effective minimum diameter and $D_{eLmax(j)}$ the effective maximum diameter for an acceptable coin of denomination j. Such effective minimum and maximum diameters may be related to the standard effective diameter $D_{eLStd(j)}$ for coins of such given denomination j by the equations $D_{eLmin(j)}=D_{eLStd(j)}-\Delta a$ and $D_{eLmax(j)}=D_{eLStd(j)}+\Delta b$, with $\Delta a$ and $\Delta b$ representing constants. Consequently, for an acceptable coin of denomination j, the elapsed time $t_{S1}$ required for such coin to traverse a distance equal to the effective diameter $d_{eL}$ will fall within a range $T_{S1(j)}LL<t_{S1}<T_{S1(j)}UL$ where $T_{S1(j)}LL=[(D_{eLmin(j)}\times t_{S2})/d]=[(D_{eLStd(j)}\times t_{S2}/d)-(\Delta a\times t_{S2}/d)]$ and $T_{S1(j)}UL=[(D_{eLmax(j)}\times t_{S2})/d]=[(D_{eLStd(j)}\times t_{S2}/d)+(\Delta b\times t_{S2}/d)]$. From what has been said hereinbefore, it will thus be apparent to those skilled in the art that, if the spacing d between the sensors $S_1$ and $S_2$ is known, and if the effective minimum and maximum diameters of acceptable large diameter coins of denomination j are known, then, for any deposited large diameter coin whose elapsed time $t_{S2}$ to traverse the distance d between the sensors is measured, a time window $T_{S1(j)}LL<t_{S1}<T_{S1(j)}UL$ can be calculated within which the status of sensor $S_1$ must change if such deposited coin is to be treated as an acceptable coin of denomination j.

In similar fashion, when a small diameter coin passes the sensors in a manner such as is depicted in FIGS. 8–11, the status of signal $V_{S1}$ on lead 40 will change from a HI to a LO at time $t_0$, as depicted in FIG. 12, when the leading edge of the coin reaches point A and begins to move past sensor $S_1$. Thereafter, since the effective diameter $d_{eS}$ of the coin is less than the spacing d between the sensors $S_1$ and $S_2$, the next change in status of the signals on leads 40 and 42 will occur at a time designated $t_{1S}$ when the trailing edge of the coin has reached point A and the coin has completed its movement past sensor $S_1$. At such time, the signal $V_{S1}$ on lead 40 returns HI. To such time, the signal $V_{S2}$ on lead 42 will have remained HI since the leading edge of the coin will not yet have reached point B and the coin will not have begun to move past sensor $S_2$. When the coin begins to move past sensor $S_2$ at time $t_{2S}$ the signal $V_{S2}$ on lead 42 will change from a HI to a LO, and such signal will thereafter remain LO until the trailing edge of the coin reaches point B at time $t_{3S}$ when the coin has completed its movement past sensor $S_2$.

It will be appreciated that the elapsed time between $t_0$ and $t_{1S}$, defined as $t_{S1}$, is inversely related to the velocity $V_1$ of the coin in traversing a distance equal to the effective diameter $d_{eS}$ of the small diameter coin, as set forth in the equation $t_{S1}=d_{eS}/V_1$, and that the elapsed time between $t_0$ and $t_{2S}$, defined as $t_{S2}$, is inversely related to the velocity $V_2$ of the coin in traversing the distance d between sensors $S_1$ and $S_2$, as set forth in the equation $t_{S2}=d/V_2$. Consequently, for a deposited small diameter coin whose elapsed time $t_{S1}$ has been measured, the elapsed time $t_{S2}$ required for such coin to reach and begin to pass a sensor $S_2$, if such coin is an acceptable coin of denomination m, can be calculated to be $t_{S2}=d\times t_{S1}/d_{eS}$, where $d_{eS}$ is the known effective diameter of an acceptable coin of such denomination.

From the foregoing, it will be appreciated that, for an acceptable small diameter coin of denomination m, the elapsed time $t_{S2}$ required for such coin to traverse the distance d between the sensors $S_1$ and $S_2$ will be expected to fall within a range $T_{S2(m)}LL<t_{S2}<T_{S2(m)}UL$, where $T_{S2(m)}LL=[(d\times t_{S1})/d_{eSmin(m)}]=[d\times t_{S1}/(D_{eLStd(m)}-\Delta c)]$ and $T_{S2(m)}UL=[(d\times T_{S1})/d_{eSmax(m)}]=[d\times t_{S1}/(D_{eLStd(m)}+\Delta d)]$, where $\Delta c$ and $\Delta d$ represent constants. It will thus be apparent to those skilled in the art that, if the spacing d between the sensors $S_1$ and $S_2$ is known and if the effective minimum and maximum diameters of acceptable small diameter coins of denomination m are known, then, for any deposited small diameter coin whose elapsed time $t_{S1}$ to traverse a distance equal to the effective diameter $d_{eS}$ of such coin is measured, a time window $T_{S2(m)}LL<t_{S2}<T_{S2(m)}UL$ can be calculated within which the status of sensor $S_2$ must change if such deposited coin is to be treated as an acceptable coin of denomination m.

Such calculations of time windows are effected in the present invention by the processing means, in response to the detection thereby of certain status changes of sensors $S_1$ and $S_2$. As has previously been indicated, processing means 22 is operatively connected to receive sensor status signals on leads 40 and 42, and is also operatively connected to memory means 24 to permit the retrieval therefrom of data stored therein. If, for each different denomination to be checked, appropriate predetermined coin sizing data, such as minimum and maximum effective diameters, or standard effective diameters and offset constants, or corresponding data, is stored in memory means 24, processing means 22 can then be designed or programmed to calculate, in response to an initial status sensing signal, time windows for each coin denomination to be checked and to monitor the status of the sensors to determine if appropriate sensor status changes thereafter occur within the calculated time windows.

Figure 13:
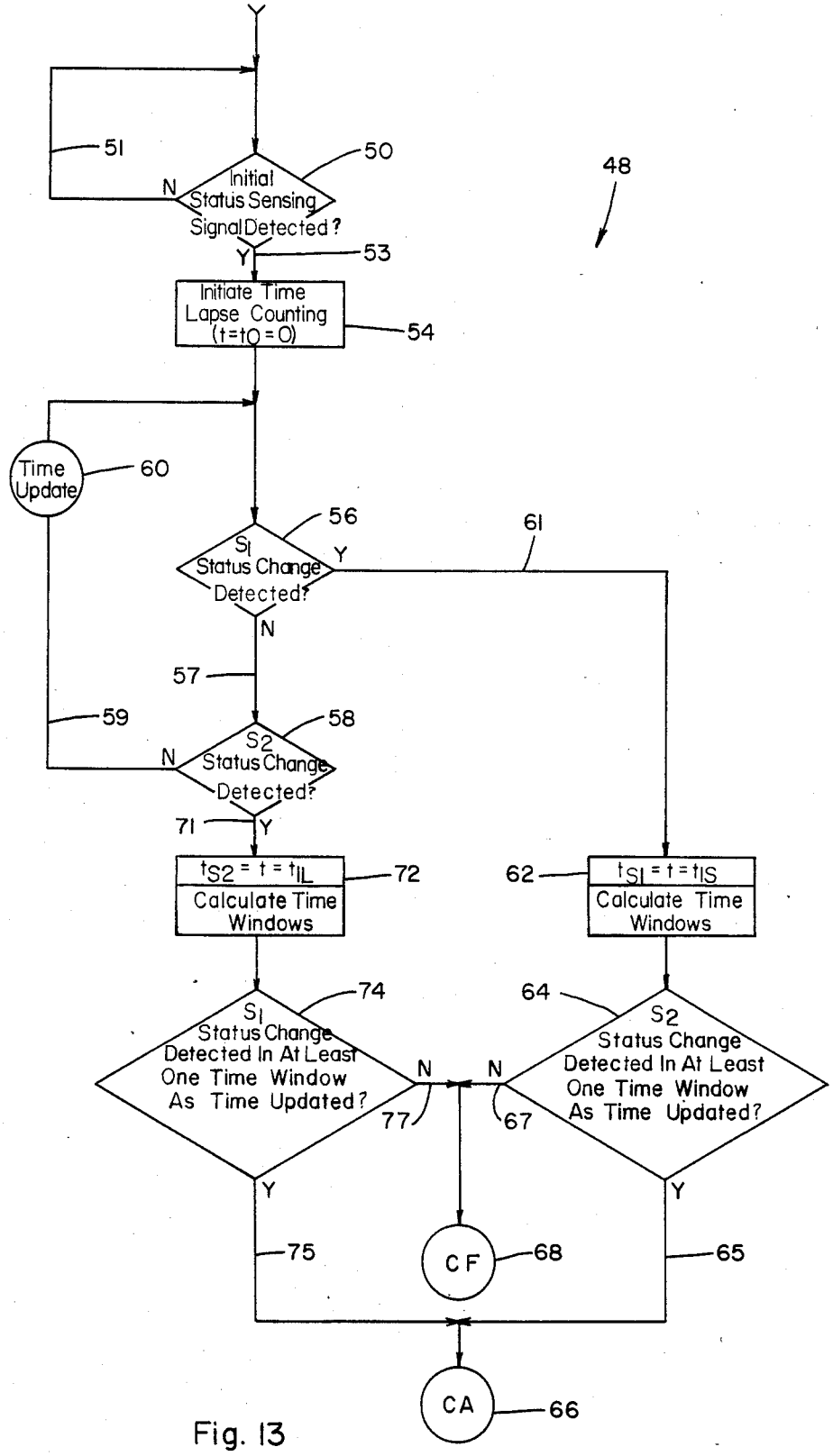
FIG. 13 is a generalized flowchart depicting an operational sequence of a typical embodiment constructed according to the present invention.

FIG. 13 depicts a generalized sequence of operation 48 that may be followed by the processing means 22 of the present invention during a coin sizing operation.

Following initiation of the coin sizing operation, the processing means 22 enters a looping sequence, as denoted by block 50 and branch 51, in which it awaits receipt of an initial sensing status signal. In the invention embodiment depicted in FIGS. 1 and 2, such initial sensing status signal occurs upon a change in the status of sensor $S_1$, as reflected by a change in signal $V_{S1}$ on lead 40 from a HI to a LO signal. When a change in status of sensor $S_1$ is detected, the operational sequence follows branch 53 from block 50, and a time lapse counting operation is initiated, such as by setting a counter t equal to zero, as denoted in block 54. Thereafter, the processing means enters another looping sequence, denoted by block 56, branch 57, block 58, branch 59, and subroutine block 60, in which loop the processing means checks for status changes in either of the sensors $S_1$ or $S_2$, and, in the absence of the detection thereof, continues time updating operations.

If a change in the status of sensor $S_1$ is the first status change detected subsequent to detection of the initial status sensing signal (FIG. 12), a small diameter coin has been deposited and is in the process of passing by sensors $S_1$ and $S_2$ in the manner depicted in FIGS. 8–11. Upon such detection, at block 56, of a change in the status of sensor $S_1$, the operational sequence follows branch 61 from such block, and the processing means then operates, as denoted in block 62, to establish a measured elapsed time $t_{S1}$ equal to time $t_{1S}$ and to calculate time windows, which are based upon the measured elapsed time and upon coin sizing data retrieved from memory means 24, for the various denominations of small diameter coins to be checked. Subsequently, as denoted in block 64, a check will be performed to determine if, as time is updated, the status of sensor $S_2$ changes within at least one of the calculated time windows. If a status change is detected within at least one of the calculated time windows, the operational sequence will proceed along branch 65 from block 64 and the coin will be treated as an acceptable coin by the coin sizing means of the present invention. In such event, further operations will be effected in accordance with a coin acceptance routine CA, as denoted by subroutine block 66, appropriate for the particular invention embodiment employed and for the particular coin-operated system with which such embodiment is utilized. On the other hand, if no status change is detected, the operational sequence will proceed along branch 67 from block 64 and the coin will be treated as an unacceptable coin. In such event, further operations will be effected in accordance with a coin failure routine CF, as denoted by subroutine block 68, appropriate for the particular invention embodiment employed and for the particular coin-operated system with which such embodiment is utilized.

If the first change in status of a sensor detected subsequent to the initial status sensing signal is a change in the status of sensor $S_2$ (FIG. 7) instead of sensor $S_1$, the deposited coin is a large diameter coin which is moving past the sensors $S_1$ and $S_2$ in the manner depicted in FIGS. 3–6. In such event, the operational sequence will follow branch 71 from block 58 and the processing means will operate, as denoted in block 72, to establish a measured elasped time $t_{S2}$ equal to time $t_{1L}$ and to calculate time windows, which are based upon such measured elapsed time and upon coin sizing data retrieved from memory means 24, for the various denominations of large diameter coins to be checked. Subsequently, as denoted in block 74, a check will be performed to determine if, as time is updated, the status of sensor $S_1$ changes within at least one of the calculated time windows. If a status change is detected within at least one of the calculated time windows, the operational sequence will proceed along branch 75 from block 74 and the coin will be treated as an acceptable coin by the coin sizing means of the present invention. In such event, further operations will be effected in accordance with the coin acceptance routine CA of subroutine block 66. On the other hand, if no status change of sensor $S_1$ is detected in any of the calculated time windows, the operational sequence will proceed along branch 77 and the coin will be treated as an unacceptable coin, with further operations being effected in accordance with the coin failure routine CF of subroutine block 68.

Figure 14:
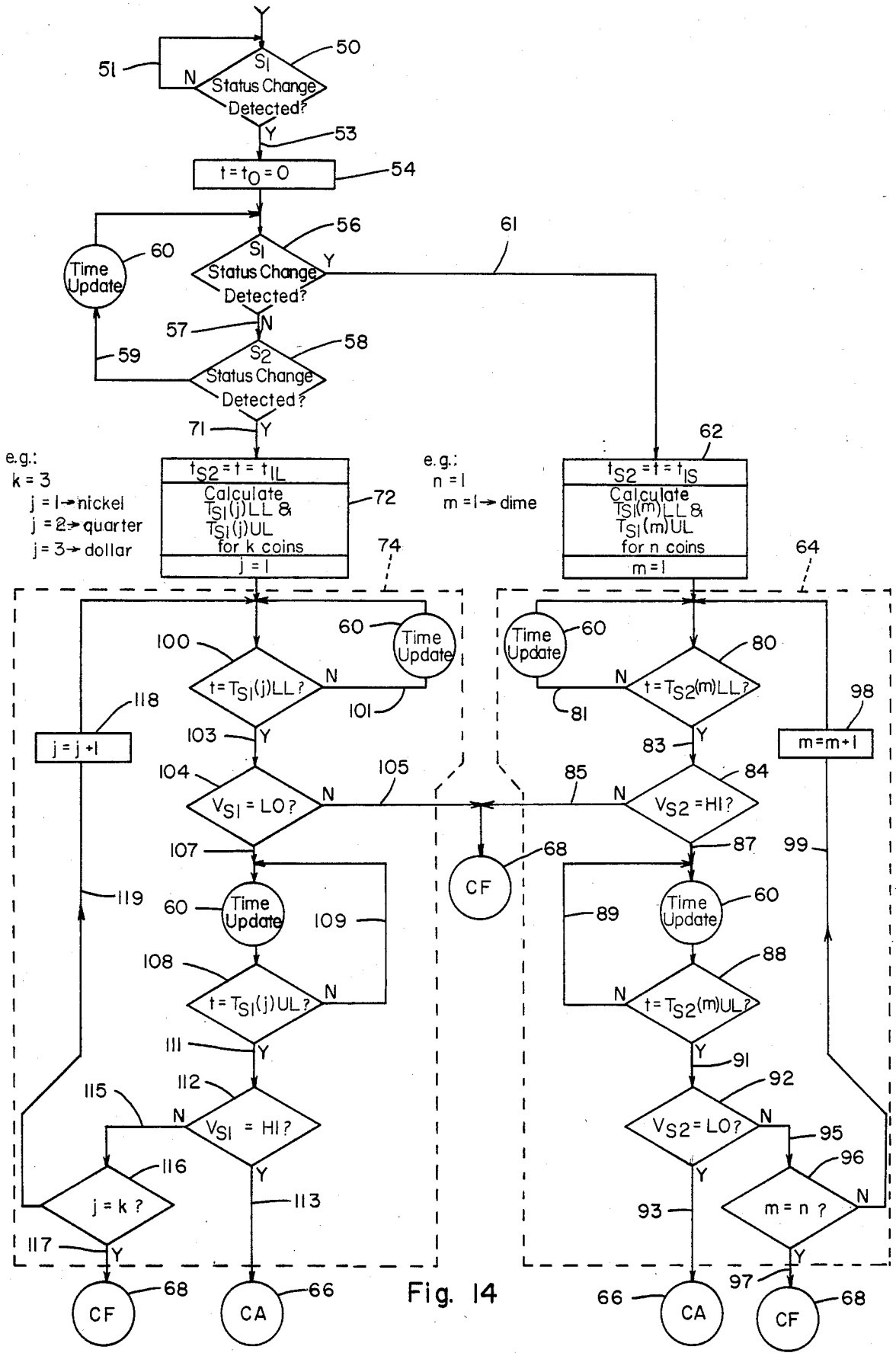
FIG. 14 is a flowchart depicting in greater detail the operational sequence of an embodiment constructed to verify coins in a system where each acceptable coin of respective coin diameter groupings is denominationally distinguishable from each other acceptable coin of such respective coin diameter grouping based upon physical dimensions; and, FIGS. 15 and 16 are flowcharts depicting in greater detail portions of an operational sequence of an embodiment constructed for use in a system where certain acceptable coins may not be readily distinguishable from one another solely on the basis of their physical dimensions.

FIG. 14 depicts a more detailed operational sequence, consistent with the operational sequence depicted in FIG. 13, which detailed operational sequence can be readily employed with a monetary system wherein non-overlapping time windows can be established for the various denominations of large diameter coins to be checked and for the various denominations of small diameter coins to be checked. Such detailed operational sequence can be advantageously utilized with coins from the U.S. monetary system for distinguishing between the larger diameter nickel (5¢), quarter (25¢), and dollar ($1.00) coins, for each of which denominations non-overlapping time windows can be established, for distinguishing the smaller diameter dime (10¢) coin therefrom, and for distinguishing such acceptable coins from unacceptable coins which may be deposited. In FIG. 14, the greater detail in the operational sequence occurs primarily within the dashed outlines 64 and 74, which outlines correspond to blocks 64 and 74 in FIG. 13.

From an examination of FIG. 14, it will be apparent to those skilled in the art that, after completion of the operations denoted in block 62, in accordance with which time windows are established by calculating upper and lower time window limits for each of the coin denominations $m=1$ to n, where n equals the number of denominations of small diameter coins to be checked, with the time windows closer to the initial time $t_0$ being associated with lower ordered coin denominations, the operational sequence enters a looping sequence, as denoted by block 80, branch 81, and subroutine block 60, in which loop the processing means continues time updating until the updated time becomes equal the lower time limit of a first time window. At such time, the operational sequence will follow branch 83 from block 80 and a check will be performed, as denoted in block 84, to determine if signal $V_{S2}$ is still HI.

If signal $V_{S2}$ has returned LO prior to the time at which the lower time limit of the first time window is detected, the deposited coin is deemed unacceptable and the operational sequence follows branch 85, with further operations being effected in accordance with coin failure routine CF of subroutine block 68. On the other hand, if, when the check denoted in block 84 is made, signal $V_{S2}$ remains HI, the operational sequence will follow branch 87 from block 84 and enter a looping sequence, as denoted by subroutine block 60, block 88, and branch 89, in which the processing means will continue time updating while awaiting detection of a time equal to the upper time limit of the first time window. When the upper time limit is detected, the operational sequence follows branch 91 from block 90 and the processing means then checks, as denoted in block 92, to determine whether signal $V_{S2}$ is then LO.

If signal $V_{S2}$ is LO at this time, indicating that the status of sensor $S_2$ has undergone a change at a time between $T_{S2(1)}LL$ and $T_{S2(1)}UL$, the coin is considered to be an acceptable coin and the operational sequence follows branch 93, as a result of which future operations are effected in accordance with the coin acceptance routine CA of block 66. On the other hand, if signal $V_{S2}$ remains HI at such time, the operational sequence follows branch 95 from block 92 and a check is then made, as denoted in block 96, to determine if m=n, that is, if the time windows for all n denominations of small diameter coins have already been checked. If so, the coin is unacceptable and the operational sequence will follow branch 97, as a consequence of which further operations will be effected in accordance with the coin failure routine CF of block 68. If not, the operational sequence will follow branch 99 and counter m will be updated, as denoted in block 98, following which the operational sequence will proceed in the same manner as has just been described, utilizing the updated value of m, and will so continue until either a status change within one of the time windows is detected, indicating that the coin is an acceptable coin, or all of the time windows have been checked, in which event the coin is an unacceptable coin.

In similar fashion, if a large diameter coin has been deposited and the operational sequence has progressed through block 72, in accordance with which time windows have been established for all of the denominations j=1 to k, where k equals the number of denominations of large diameter coins to be checked, with the time windows closer to the initial time $t_0$ being associated with lower ordered coin denominations, the operational sequence will enter a looping sequence within dotted outline 74, as denoted by block 100, branch 101, and subroutine block 60, in which loop the processing means continues time updating until the updated time becomes equal to the lower time limit of a first time window. At such time, the operational sequence will follow branch 103 from block 100 and a check will be performed, as denoted in block 104, to determine if signal $V_{S1}$ is still LO.

If signal $V_{S1}$ has returned HI prior to the time at which the lower limit of the first time window is detected, the deposited coin is deemed unacceptable and the operational sequence follows branch 105, with further operations being effected in accordance with coin failure routine CF of subroutine block 68. On the other hand, if, when the check denoted in block 104 is made, signal $V_{S1}$ remains LO, the operational sequence will follow branch 107 from block 104 and enter a looping sequence, as denoted by subroutine block 60, block 108, and branch 109, in which the processing means will continue time updating while awaiting detection of a time equal to the upper time limit of the first time window. When the upper time limit is detected, the operational sequence follows branch 111 from block 110 and the processing means then checks, as denoted in block 112, to determine whether signal $V_{S1}$ is HI.

If signal $V_{S1}$ is HI at such time, indicating that the status of sensor $S_1$ has undergone a change at a time between $T_{S1(1)}LL$ and $T_{S1(1)}UL$, the coin is considered to be an acceptable coin and the operational sequence follows branch 113, as a result of which future operations are effected in accordance with the coin acceptance routine CA of block 66. On the other hand, if signal $V_{S1}$ remains LO at such time, the operational sequence follows branch 115 from block 112 and a check is then made, as denoted in block 116, to determine if j=k, that is, if the time windows for all k denominations of large diameter coins have already been checked. If so, the coin is unacceptable and the operational sequence will follow branch 117, as a consequence of which further operations will be effected in accordance with the coin failure routine CF of block 68. If not, the operational sequence will follow branch 119 and counter j will be updated, as denoted in block 118, following which the operational sequence will proceed in the same manner as has just been described, utilizing the updated value of j, and will so continue until either a status change within one of the time windows is detected, indicating that the coin is an acceptable coin, or all of the time windows have been checked, in which event the coin is an unacceptable coin.

Figure 15:
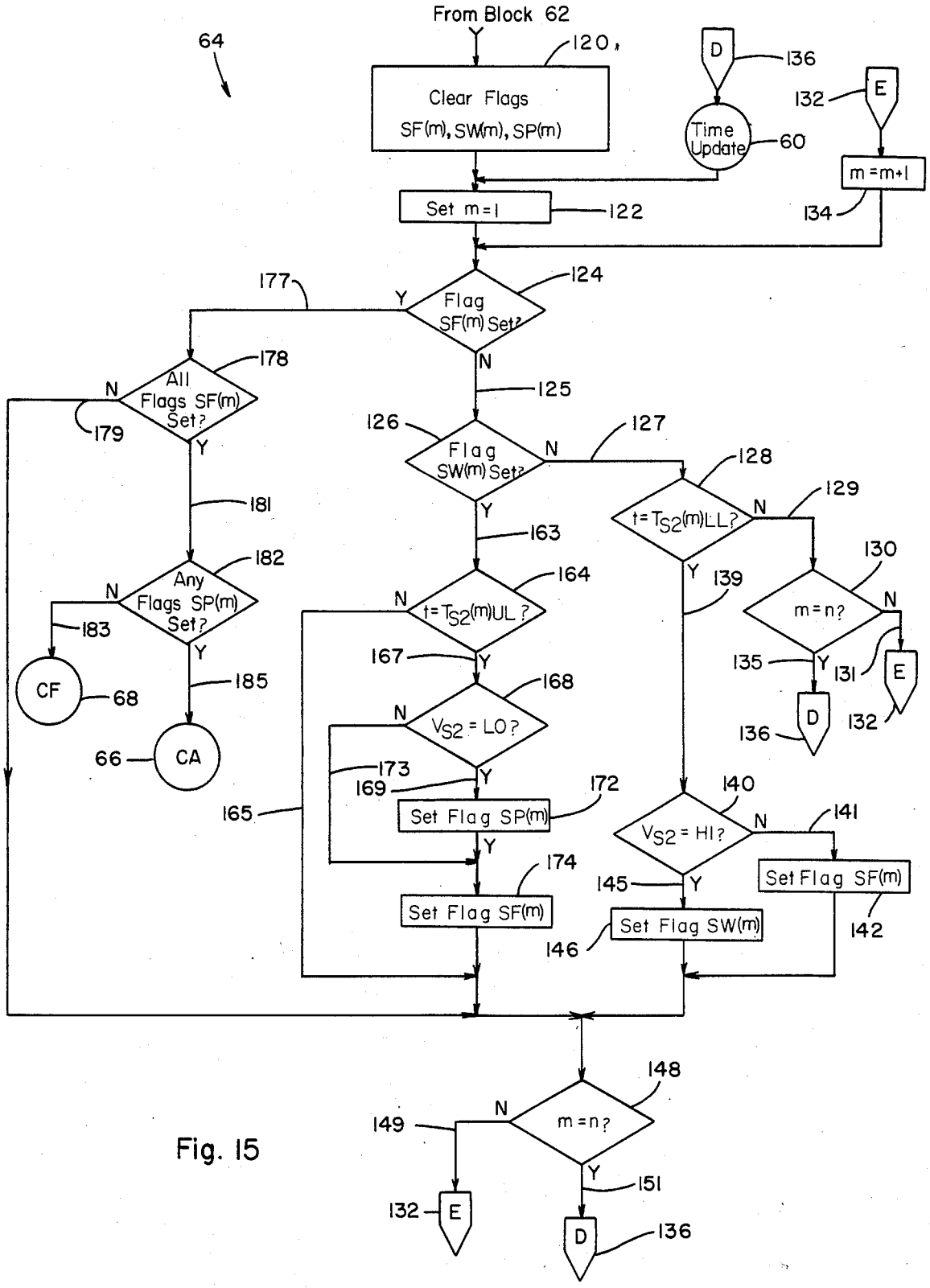

FIG. 15 depicts an alternative, detailed operational sequence that may be followed by a processing means 22 in checking, as denoted in block 64 of FIG. 13, for a status change of sensor $S_2$, especially in a monetary system where the time windows for two or more denominations of small diameter coins may overlap. Such detailed operational sequence utilizes window flags SW(m), finish flags SF(m), and coin pass flags SP(m), for m=1 to n, where n equals the number of denominations of small diameter coins to be checked. The operational sequence depicted in FIG. 15 is entered upon completion of the operations denoted by block 62 in FIG. 13, in accordance with which all the appropriate time windows will have been established. When the operational sequence depicted in FIG. 15 is first entered, all of the window flags SW(m), finish flags SF(m), and coin pass flags SP(m) are cleared, as denoted in block 120 in FIG. 15, and counter m is then set to one, as denoted in block 122. Thereafter, as will be apparent from an examination of FIG. 15 by those skilled in the art, the operational sequence loops through block 124, branch 125, block 126, branch 127, block 128, branch 129, block 130, branch 131, entry point E, denoted by number 132, and block 134, in accordance with which block 134 counter m is updated, back to block 124, and so continues looping until, in a check performed at block 130, m is detected to be equal to n. When such equality is detected at block 130, a time update operation is conducted and the counter m is reset to one, as is denoted by following branch 135 from block 130 through entry point D, denoted by number 136, subroutine block 60, and block 122 back to block 124.

The operational sequence will thereafter continue looping back to block 124 in the foregoing described manner until, for some coin denomination m, in the check performed in block 128, the updated time t is found to be equal to the lower time limit $T_{S2(m)}LL$ for the time window established for such coin denomination. Upon satisfaction of the equality, the operational sequence will follow branch 139 to block 140, in accordance with which the processing means will check to determine whether signal $V_{S2}$ remains HI at such time.

If signal $V_{S2}$ has returned LO prior to the time at which the lower time limit is detected, the operational sequence will follow branch 141 from block 140, as a consequence of which the mth finish flag SF(m) will be set, as denoted by block 154. Thereafter, a check will be performed, as denoted in block 148, to determine whether m then equals n, that is, whether the denomination m which has just been checked is the highest ordered denomination of small diametered coin to be checked. If not, the operational sequence follows branch 149 and re-enters the previously described looping sequence through entry point E, denoted by number 132; if so, the operational sequence follows branch 151 and re-enters the previously described looping sequence through entry point D, denoted by number 136.

If, when block 140 is reached in the operational sequence hereinbefore discussed, signal $V_{S2}$ is found to be HI, the operational sequence will thereafter follow branch 145 instead of branch 141, as a result of which the mth window flag SW(m) will be set, as denoted in block 146, and a check will then be performed, as denoted in block 148, to determine whether m equals n. As explained previously, if m does not equal n, the operational sequence will re-enter the previously described looping sequence through entry point E. On the other hand, if m does equal n, the operational sequence will re-enter the looping sequence at entry point D.

Thereafter, the operational sequence will continue looping in the manner hereinbefore described until, in a check performed at block 126, the mth window flag SW(m) is found to be set. When the mth window flag SW(m) is found to be set, which flag indicates that the status of sensor $S_2$ had not changed at a time prior to the time at which the lower time limit for the time window of coin denomination m was detected, the operational sequence will then follow branch 163 from block 126, as a consequence of which a check will be performed, as denoted in block 164, to determine whether the updated time t is then equal to the upper time limit $T_{S2(m)}UL$ for the time window for the coin of denomination m. If such upper time limit has not yet been reached, the operational sequence will follow branch 165 and a check will then be performed, as denoted in block 148, to determine whether m equals n. As explained previously, if m does not equal n, the operational sequence will re-enter the previously described looping sequence through entry point E. On the other hand, if m does equal n, the operational sequence will re-enter the looping sequence at entry point D. On the other hand, if the upper time limit has been reached, the operational sequence will follow branch 167, instead of branch 165, as a result of which a check will be made, as denoted by block 168, to determine whether signal $V_{S2}$ is then LO.

If signal $V_{S2}$ is LO at such time, indicating that the status of sensor $S_2$ has undergone a change at a time within the time window established for coin denomination m, the operational sequence will follow branch 169 and the mth coin pass flag SP(m) will be set. On the other hand, if signal $V_{S2}$ remains HI at such time, indicating that the status of sensor $S_2$ has not undergone a change at a time within the time window, the operational sequence will follow branch 173, instead of branch 169, thereby bypassing block 172 and leaving the mth coin pass flag SP(m) in a cleared or reset condition. Regardless of whether branch 169 or branch 173 is followed from block 168, the mth finish flag SF(m) will thereafter be set, as denoted in block 174, to indicate that checking operations have been completed for coin denomination m, and a check will then be performed, as denoted in block 148, to determine whether m=n. As previously described, depending upon the result of the check performed in accordance with block 148, the operational sequence will then re-enter the looping sequence described hereinbefore through either entry point D or entry point E.

The operational sequence will thereafter continue looping in the manner described hereinbefore unless or until, in the check performed in block 124, for a particular coin denomination m, the mth finish flag SF(m) is found to be set. In such event, the operational sequence will follow branch 177 from block 124 and a check will then be performed, as denoted in block 178, to determine if all of the finish flags SF(m) for m=1 to n are set. If not, the operational sequence will follow branch 179 and a check will then be performed, as denoted in block 148, to determine whether m=n. As previously described, depending upon the result of the check performed in accordance with block 148, the operational sequence will then re-enter the looping sequence described hereinbefore through either entry point D or entry point E. On the other hand, if all of the finish flags SF(m) are found to be set in the check performed at block 178, indicating that the checking of all time windows has been completed, the operational sequence will follow branch 181 and a check will then be performed, as denoted in block 182, to determine whether any of the coin pass flags SP(m) for m=1 to n have been set. If not, the operational sequence will follow branch 183 and further operations will be effected in accordance with coin failure routine CF of block 68. On the other hand, if any of such flags have been set, the operational sequence will follow branch 185, instead of branch 183, and further operations will then be effected in accordance with coin acceptance routine CA of block 66.

Figure 16:
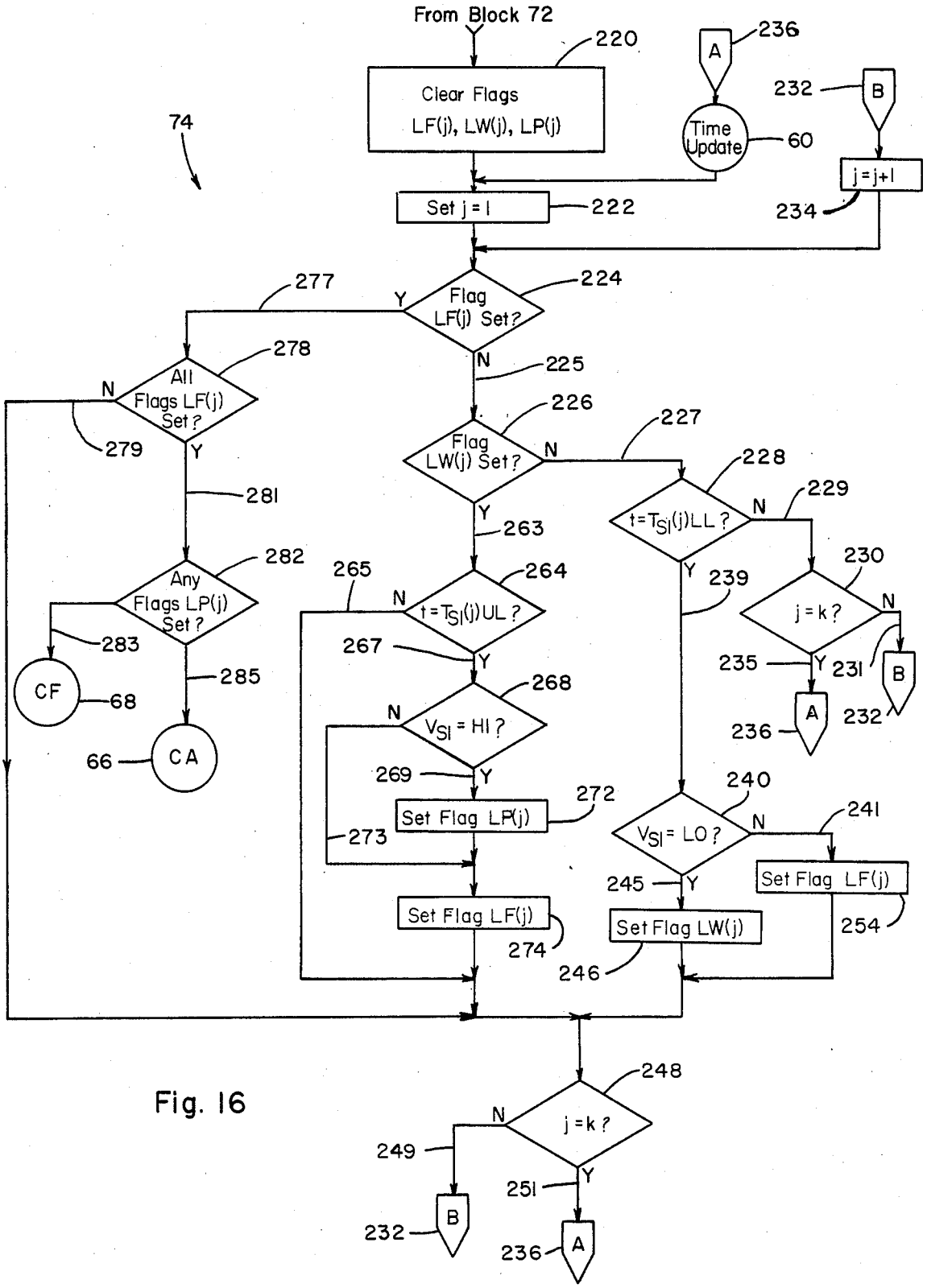

FIG. 16, which is similar to FIG. 15, shows an alternative, detailed operational sequence that may be employed in checking, as denoted in block 74 of FIG. 13, for a status change of sensor $S_1$, especially in a monetary system where two or more denominations of large diameter coins may have overlapping time windows. As will be readily apparent to those skilled in the art, the components 220–285 of the operational sequence depicted in FIG. 16 correspond generally to the respective components 120–185 of the operational sequence depicted in FIG. 15. It will be appreciated, however, that the sequence depicted in FIG. 16 is checking to determine whether signal $V_{S1}$ on lead 40 changes from a LO to a HI state during the time windows established for the denominations of large diameter coins to be checked instead of checking, as depicted in FIG. 15, to determine whether signal $V_{S2}$ on lead 42 changes from a HI to a LO during the time periods established for the denominations of small diameter coins to be checked.

From what has been said, it will be apparent that alternative, detailed methods of effecting the more generalized operational steps required by the present invention may be readily practiced, which detailed methods may vary depending upon the constructional details of the particular embodiment of the present invention employed, as well as upon the constructional details of the coin-operated system with which the invention is utilized, the features of such system, and the particular monetary system involved.

It will also be appreciated that many variations in the constructional details of the invention are contemplated, including variations in the positioning of the sensors. In one foreseen embodiment of the invention the sensors may be so positioned that the spacing d between the sensors and the ordering of such sensors is such that, with the particular denominations of coins to be checked, the initial status sensing signal of the invention is produced not at a time when the deposited coin first begins its movement past a sensor, but, rather, at a time when such coin has reached some other point in its movement past the sensors, such as when the coin has completed its movement past a first sensor. Similarly, the two further status sensing signals need not be the signals described hereinbefore with reference to the embodiment of FIGS. 1 and 2, but may be signals produced when the coin has reached other points in movement past the sensors, one of which could be a signal produced when the coin has completed its movement past both of the sensors.

It should also be noted that the spacing d between the sensors $S_1$ and $S_2$ may be selected to be such that, for any given monetary system, all acceptable coins will be coins of either relatively small or relatively large diameters. Thus, if the spacing is selected so that all acceptable coins are of relatively large diameter, when the operational sequence depicted in FIG. 13 is followed and a status change with regard to sensor $S_1$ is detected in the check performed at block 56, such detection is an indication that a coin of relatively small diameter had been deposited and so identified. Since, with such embodiment, all small diameter coins are to be deemed unacceptable, the operational sequence can, in such instance, follow a branch in accordance with which further operations will be effected in accordance with the coin failure routine CF without any necessity of first performing the operations denoted in blocks 62 and 64 of FIG. 13.

In other foreseen embodiments the sensors may be positioned in such a manner that the sensors are at two different heights above the coin rail, as is the case with respect to sensors $S_1$ and $S_2'$ in FIG. 2, where sensor $S_1$ is positioned at height h and sensor $S_2'$ is positioned at height $h+\Delta h$. It will be readily apparent to those skilled in the art that, because of the relationship between the spacings d, $d_x$, and $\Delta h$, as set forth in the equation $(d_x)^2=d^2+\Delta h^2$, sensors positioned at different heights can be readily and advantageously utilized, and, in certain circumstances may even be preferable to sensors positioned at the same height.

From what has been said hereinbefore, it will also be appreciated by those skilled in the art that the predetermined coin sizing data that is stored in memory means 24 prior to the initiation of coin sizing determinations by the present invention can be readily obtained and particularized for each particular embodiment of the invention on an individual unit basis at the time of such unit's construction. Such data can be obtained for each denomination j of large diameter coins to be checked by depositing known acceptable coins of denomination j and measuring the times $t_{S2}$ and $t_{S1}$ therefor. From the discussion presented hereinbefore regarding the relationship between $t_{S1}$ and $t_{S2}$, it will thus be apparent that the measured times $t_{S1}$ can then be divided by the measured times $t_{S2}$ to obtain the necessary predetermined coin sizing data. In similar fashion, data for each denomination m of small diameter coins can be obtained by dividing the measured times $t_{S1}$ by the measured times $t_{S2}$ for acceptable coins of such denomination as such acceptable small diameter coins are deposited and move past the sensors. It will be appreciated that the predetermined coin sizing data need not be so obtained, however, and that many other methods for obtaining appropriate coin sizing data could be equally as well utilized.

It will also be appreciated that the sensing means and memory means identified herein and referred to with respect to the particular embodiment discussed hereinbefore are examples of sensing means and memory means that may be employed in the present invention, and that many other types of sensing means and memory means can also be advantageously employed in or with the means and method of the present invention.

From all that has been said, it should now be clear that there has been shown and described a coin sizing means and method which fulfills the various objects and advantages sought therefor. It will be apparent to those skilled in the art, however, that many changes, modifications, variations, and other uses and applications of the subject coin sizing means and method are possible and contemplated. All such changes, modifications, variations, and other uses and applications which do not depart from the spirit and scope of the invention are deemed to be covered by the invention, which is limited only by the claims which follow.

What is claimed is:

1. A coin sizing means for use in distinguishing between various coins as they travel along a predefined path, comprising sensing means positioned along the predefined path of coin travel to detect the movement of a coin thereby, said sensing means including means for producing an initial sensing status signal and two further sensing status signals as the coin moves along said predefined path by said sensing means and reaches particular positions relative to said sensing means, memory means including means for storing predetermined coin sizing data, and processing means operatively connected to said sensing means to receive said sensing status signals produced thereby and also operatively connected to said memory means to permit the retrieval therefrom of data stored therein, said processing means responsive to production of said initial sensing status signal to initiate a time lapse counting operation, said processing means thereafter responsive to production of the first occurring of the two further sensing status signals to establish an elapsed time, to retrieve coin sizing data from said memory means, and to calculate upper and lower time limits based upon said elapsed time and upon the retrieved coin sizing data in order to thereby establish a time window interval, said processing means subsequently responsive to production within said time window interval of the second occurring of the two further sensing status signals so as to distinguish a coin whose movement past said sensing means effects production within the time window interval of said second occurring of the two further sensing status signals from other coins whose movements past said sensing means effect productions of the second occurring of the two further sensing status signals at times outside of the time window interval.

2. The coin sizing means of claim 1 wherein said sensing means includes first and second spaced sensor means.

3. The coin sizing means of claim 2 wherein said initial sensing status signal is produced by one of said sensor means indicating that the coin in its movement has reached an initial position relative to said sensing means, one of said further sensing status signals being produced subsequent to said initial status sensing signal by a predetermined one of said sensor means, production of said one of said further sensing status signals indicating that the coin has reached a particular position relative to said predetermined one of said sensor means, the other of said further sensing status signals being produced subsequent to said initial sensing status signal by the other of said sensor means, production of said other of said further sensing status signals indicating that the coin has reached a particular position relative to said other of said sensor means.

4. The coin sizing means of claim 3 wherein said one of said sensor means is said first sensor means.

5. The coin sizing means of claim 4 wherein said predetermined one of said sensor means is said first sensor means and said other of said sensor means is said second sensor means.

6. The coin sizing means of claim 5 wherein the production of said initial sensing status signal indicates that the coin has begun to move past said first sensing means and the production of said one of said further sensing status signals by said first sensing means indicates that the coin has completed its movement past said first sensing means.

7. The coin sizing means of claim 4 wherein said predetermined one of said sensor means is said second sensor means and said other of said sensor means is said second sensor means.

8. The coin sizing means of claim 1 wherein said sensing means includes optical couplers.

9. The coin sizing means of claim 2 wherein deposited coins traverse a base pathway in their movement along the predefined path and wherein said first and second sensor means are positioned at different heights above the base pathway.

10. The coin sizing means of claim 2 wherein deposited coins traverse a base pathway in their movement along the predefined path and wherein said first and second sensor means are both positioned at essentially the same height above the base pathway.

11. The coin sizing means of claim 2 wherein said first and second sensor means are spaced apart from one another a distance d as measured longitudinally along the predefined path.

12. The coin sizing means of claim 11 wherein deposited coins traverse a base pathway in their movement along the predefined path, wherein the sensor means positioned at the lowest height above the base pathway is positioned at a height h, and wherein said distance d is less than the length of a chord of a smallest diameter coin of interest where such chord is measured along a line parallel to the base pathway passing through the sensor means positioned at height h when the smallest diameter coin of interest is resting on the base pathway with the geometric center of such coin being located between said first and second sensor means.

13. The coin sizing means of claim 12 wherein said first sensor means is defined as the first sensor means past which the coin begins to move and said second sensor means is defined as the second sensor means past which the coin begins to move, and wherein said initial sensing status signal is produced by said second sensor means indicating that the coin in its movement has reached an initial position relative to said second sensor means at which such coin has begun to move past said second sensor means, the coin at such time having already partially completed its movement past said first sensor means, one of said further sensing status signals being produced subsequent to said initial sensing status signal by said first sensor means, production of said one of said further sensing status signals indicating that the coin has completed its movement past said first sensor means, the other of said further sensing status signals being produced subsequent to said initial sensing status signal, production of said other of said further sensing status signals indicating that the coin has completed its movement past said second sensor.

14. The coin sizing means of claim 11 wherein deposited coins traverse a base pathway in their movement along the predefined path, wherein the sensor means positioned at the lowest height above the base pathway is positioned at a height h, and wherein said distance d is greater than the length of a chord of a smallest diameter coin of interest where such chord is measured along a line parallel to the base pathway passing through the sensor means positioned at height h when the smallest diameter coin of interest is resting on the base pathway with the geometric center of such coin being located between said first and second sensor means.

15. The coin sizing means of claim 14 wherein said distance d is less than the length of a chord of a largest diameter coin of interest where such chord is measured along a line parallel to the base pathway passing through the sensor means positioned at height h when the largest diameter coin of interest is resting on the base pathway with the geometric center of such coin being located between said first and second sensor means.

16. The coin sizing means of claim 1 wherein said processing means is a programmed microprocessor.

17. A coin sizing circuit for use with a coin-operated vending system for distinguishing between various deposited coins as they travel along a predefined path, comprising first and second spaced sensors positioned to detect the movement of a deposited coin thereby, the sensors being responsive to movement of the deposited coin to produce an initial sensing status signal and two further sensing status signals as the coin moves along said predefined path by the sensors and reaches particular positions relative thereto, memory means having predetermined coin sizing data stored therein, and processing means operatively connected to said sensors to receive the sensing status signals produced thereby and also operatively connected to said memory means to permit the retrieval therefrom of the data stored therein, said processing means being responsive, subsequent to the production by said sensors of the initial sensing status signal, to the first occurring of the two further sensing status signals to establish a time window interval based upon the elapsed time between said initial sensing status signal and said first occurring of said further sensing status signals and upon said predetermined coin sizing data retrieved from said memory, said processing means thereafter being responsive to production within the time window interval of the second occurring of the two further sensing status signals so as to distinguish a coin whose movement past said sensors effects production within the time window interval of the second occurring of the two further sensing status signals from other coins whose movements past said sensors effect productions of the second occurring of the two further sensing status signals at times outside of the time window interval.

18. A coin sizing means for use in a coin-operated vending system for distinguishing between various deposited coins as they travel along a predefined path, comprising two spaced sensing means positioned along the predefined path of coin travel to detect the movement of a deposited coin thereby, said sensing means including means for producing an initial sensing status signal and two further sensing status signals as the coin moves along said predefined path by said sensing means and reaches particular positions relative to said sensing means, said initial sensing status signal being produced by one of said sensing means and indicating that the coin in its movement along the predefined path has reached an initial position relative to said one of said sensing means, one of said further sensing status signals being produced subsequent to said initial sensing status signal by a predetermined one of said sensing means, production of said one of said further sensing status signal indicating that the coin has reached a particular position relative to said predetermined sensing means, the other of said further sensing status signals being produced subsequent to said initial sensing status signal by the other of said sensing means, production of said other of said further sensing status signals indicating that the coin has reached a particular position relative to said other of said sensing means, memory means including means for storing predetermined coin sizing data, and processing means operatively connected to said sensing means to receive said sensing status signals produced thereby and also operatively connected to said memory means to permit the retrieval therefrom of data stored therein, said processing means including a microprocessor programmed to (a) respond to production of said initial sensing status signal to initiate a time lapse counting operation, (b) respond to production of the first occurring of the two further sensing status signals (1) to establish an elapsed time, (2) to retrieve coin sizing data from said memory means, and (3) to calculate upper and lower time limits based upon said elapsed time and upon the retrieved coin sizing data in order to thereby establish a time window interval, and (c) respond to production within said time window interval of the second occurring of the two further sensing status signals so as to distinguish a coin whose movement past said sensing means effects production within the time window interval of said second occurring of the two further sensing status signals from other coins whose movements past said sensing means effect productions of the second occurring of the two further sensing status signals at times outside of the time window interval.

19. A microprocessor controlled coin sizing means for distinguishing between various deposited coins as they travel along a predefined path, said coin sizing means comprising sensing means positioned along the predefined path of coin travel, the sensing means including means for producing an initial sensing status signal and two further sensing status signals as the coin moves along the predefined path by the sensing means and reaches particular positions relative thereto, the initial status sensing signal being produced when a deposited coin reaches an initial position relative to the sensing means, the two further status sensing signals being produced when the deposited coin reaches other respective positions relative to the sensing means, memory means including means for storing predetermined coin sizing data, and a microprocessor operatively connected to the sensing means to receive sensing status signals produced thereby and also operatively connected to the memory means to permit the retrieval therefrom of data stored therein, said microprocessor programmed to (a) initiate a time lapse counting operation in response to production of an initial status sensing signal, (b) thereafter respond to production of the first occurring of the two further sensing status signals (1) to establish an elapsed time count corresponding to the elapsed time between production of the initial sensing status signal and the first occurring of the two further sensing status signals, and (2) to establish a time window interval, based upon the established elapsed time count and upon the predetermined coin sizing data stored in and retrieved from said memory means, and (c) subsequently respond to production within the time window interval of the second occurring of the two further sensing status signals to distinguish a coin whose movement past the sensors effects production within the time window interval of the second occurring of the two further sensing status signals from other coins whose movements past the sensing means effect productions of the second occurring of the two further sensing status signals at times outside of the time window interval.

20. A method of operation of a coin sizing means for use in distinguishing between various deposited coins as they travel along a predefined path, the coin sizing means including sensing means positioned along the predefined path of coin travel, the sensing means including means for producing an initial sensing status signal and two further sensing status signals as the coin moves along the predefined path by the sensing means and reaches particular positions relative thereto, the initial status sensing signal being produced when a deposited coin reaches an initial position relative to the sensing means, the two further status sensing signals being produced when the deposited coin reaches other respective positions relative to the sensing means, memory means including means for storing predetermined coin sizing data, and processing means operatively connected to the sensing means to receive sensing status signals produced thereby and also operatively connected to the memory means to permit the retrieval therefrom of data stored therein, the method comprising the steps of (a) initiating a time lapse counting operation in response to production of an initial status sensing signal (b) thereafter responding to production of the first occurring of the two further sensing signals time count (1) to establish an elapsed time count corresponding to the elapsed time between production of the initial sensing status signal and the first occurring of the two further sensing status signals, and (2) to establish a time window interval, based upon the established elapsed time count and upon the predetermined coin sizing data stored in and retrieved from said memory means, and (c) subsequently responding to production within the time window interval of the second occurring of the two further sensing status signals to distinguish a coin whose movement past the sensors effects production within the time window interval of the second occurring of the two further sensing status signals from other coins whose movements past the sensing means effects production of the second occurring of the two further sensing status signals at times outside of the time window interval.

21. The method of claim 20 wherein step (a) includes the step of checking for the production of an initial sensing status signal.

22. The method of claim 21 wherein step (b) includes the step of checking for the production of the first occurring of the two further sensing status signals.

23. The method of claim 21 wherein step (b) also includes the step of retrieving, prior to step (b)(2), predetermined coin sizing data from the memory means.

* * * * *

CERTIFICATE OF CORRECTION

Patent No. 4,646,904 Dated March 3, 1987

Inventor(s) Ronald A. Hoormann

It is certified that error appears in the above-identified patent and that said Letters Patent are hereby corrected as shown below:

Column 4, line 12, the radical should extend over the entire right side of the equation so that the equation is expressed as --$d_e = \sqrt{((D_t \times h) - h^2)/0.25}$--.

Column 5, lines 33-34, the inequality should be expressed as

--$D_{eLmin(j)} < d_{eL} < D_{eLmax(j)}$--.

Column 5, in order to properly set forth the equations included in lines 45-48, such lines should be written as --range $T_{S1(j)}LL < t_{S1} < T_{S1(j)}UL$ where $$T_{S1(j)}LL = [(D_{eLmin(j)} \times t_{S2})/d]$$
$$= [(D_{eLStd(j)} \times t_{S2}/d) - (\Delta a \times t_{S2}/d)]$$

and $$T_{S1(j)}UL = [(D_{eLmax(j)} \times t_{S2})/d]$$
$$= [(D_{eLStd(j)} \times t_{S2}/d) + (\Delta b \times t_{S2}/d)].$$

From what has been--.

CERTIFICATE OF CORRECTION

Patent No. 4,646,904 Dated March 3, 1987

Inventor(s) Ronald A. Hoormann

It is certified that error appears in the above-identified patent and that said Letters Patent are hereby corrected as shown below:

Column 6, in order to properly set forth the equations included in lines 33-35, such lines should be written as --where $$T_{S2(m)}LL = [(d \times t_{S1})/d_{eSmin(m)}]$$
$$= [d \times t_{S1}/(D_{eLStd(m)} - \Delta c)]$$

and $$T_{S2(m)}UL = [(d \times T_{S1})/d_{eSmax(m)}]$$
$$= [d \times t_{S1}/(D_{eLStd(m)} + \Delta d)],$$

where $\Delta c$ and $\Delta d$--.

Column 6, lines 43-44, the inequality should be expressed as

--$T_{S2(m)}LL < t_{S2} < T_{S2(m)}UL$--.

Column 18, lines 42-43 from the top of the page (but adjacent to column numeral "40"), the phrase "time count" should be deleted.

Signed and Sealed this

Twenty-ninth Day of March, 1988

*Attest:*

DONALD J. QUIGG

*Attesting Officer* *Commissioner of Patents and Trademarks*